US005218773A

United States Patent [19]

Beekman

[11] Patent Number: 5,218,773

[45] Date of Patent: Jun. 15, 1993

[54] TORSIONALLY STABILIZED ATHLETIC SHOE

[76] Inventor: Stanley Beekman, 30033F Center Ridge Rd., Westlake, Ohio 44145

[21] Appl. No.: 779,151

[22] Filed: Oct. 21, 1991

Related U.S. Application Data

[63] Continuation of Ser. No. 296,088, Jan. 11, 1989, abandoned.

[51] Int. Cl.[5] ..... A43B 23/08

[52] U.S. Cl. ..... 36/68; 36/69; 36/30 R

[58] Field of Search ..... 36/69, 68, 114, 30 R, 36/38, 28

[56] References Cited

U.S. PATENT DOCUMENTS

| | | | |
|---|---|---|---|
| 4,255,877 | 3/1981 | Bowerman | 36/68 X |
| 4,288,929 | 9/1981 | Norton et al. . | |
| 4,302,892 | 12/1981 | Adamik . | |
| 4,459,765 | 7/1984 | Power . | |
| 4,484,397 | 11/1984 | Curley, Jr. . | |
| 4,490,928 | 1/1985 | Kawashima . | |
| 4,506,460 | 3/1985 | Rudy | 36/69 X |
| 4,510,700 | 4/1985 | Brown | 36/28 X |
| 4,598,487 | 7/1986 | Misevich | 36/114 |
| 4,625,435 | 12/1986 | Ueda . | |
| 4,694,591 | 9/1987 | Banich et al. . | |
| 4,730,402 | 3/1988 | Norton et al. . | |
| 4,759,136 | 7/1988 | Stewart et al. . | |
| 4,854,055 | 8/1989 | Sugiyama et al. | 36/68 X |

FOREIGN PATENT DOCUMENTS

| | | | |
|---|---|---|---|
| 0146208 | 6/1985 | European Pat. Off. | 36/69 |
| 2114869 | 9/1983 | United Kingdom | 36/114 |

*Primary Examiner*—Jimmy G. Foster
*Assistant Examiner*—Ted Kavanaugh
*Attorney, Agent, or Firm*—D. Peter Hochberg; Mark Kusner

[57] ABSTRACT

An athletic shoe with a torsional stabilizer incorporated therein comprises a substantially flat horizontal base member extending rearward across the width of the shoe, parallel to the sole of the shoe, from a transverse line located adjacent to and behind the phalangeal/-metatarsal joints, at least to a line adjacent to, and forward of the heel portion of the shoe. Except for transverse edges forward of the heel-end, the base member is provided with a substantially vertical flange portion attached to the edges thereof, which serves to stabilize the base member relative to torsional forces acting thereon.

14 Claims, 2 Drawing Sheets

TORSIONALLY STABILIZED ATHLETIC SHOE

This is a continuation of co-pending application Ser. No. 296,088 filed on Jan. 11, 1989 now abandoned.

TECHNICAL FIELD

This invention relates to an improved athletic shoe. More particularly, this invention relates to an athletic shoe with improved torsional characteristics. Specifically, this invention relates to an athletic shoe having a horizontal stiffening member with a generally vertical edge flange forming an integral part thereof inserted adjacent to the shoe's midsole region, thereby providing the shoe with enhanced torsional stability.

BACKGROUND OF THE INVENTION

In recent years, individuals have increasingly been made aware of the advantage of vigorous exercise, including its beneficial effect on the heart, as well as nuscle tone in general. As a result of this awareness, long distance jogging, for example, has become very popular, particularly among individuals wishing to be involved in outdoor activities, and at the same time, wanting to enjoy the benefits resulting from strenuous physical exertion.

Many of those engaging in the sport, and other activities requiring prolonged and intense movement of the legs and feet have unfortunately become aware of the fact that such exercise can result in painful injuries and afflictions. For example, "shin splints," painful straining of the extensor muscles in the lower leg resulting from running on a hard surface can be developed. In addition, planter fasciitis, a hurtful inflammation of the tissue on the bottom of the foot can be experienced, as well as a malady involving "jamming" of the large toe, commonly referred to as "turftoe."

As might be imagined, a wide variety of sports equipment has been developed to facilitate running-related activities. This is particular true in the case of athletic footwear such as specially designed running shoes which frequently employ board last, or slip last construction, or combinations thereof to reduce the weight of the shoes. With respect to athletic shoes, the objective has been to make the shoes as light as feasible to minimize the energy required in exercising in them to the extent possible. To further reduce the shoe's weight, lighter-weight construction materials such as ethylene, vinyl acetate, nylon, polyurethane, and various other synthetics have been employed in their fabrication. The shoe designs achieved, however, have necessitated a compromise insofar as the wearer is concerned, inasmuch as while lighter footwear reduces the amount of energy expended, the weight loss has been achieved at the cost of the shoe's structural stability.

Stability of an athletic shoe is a matter of no minor importance since the manipulation of an individual's foot during walking or running places a significant torsional force on the shoe, relative to its longitudinal axis. Unless the twisting thus imposed is resisted, it tends to result in pronation, or supination, i.e., a "rolling in" or a "rolling out" of the shoe and the foot of the wearer. In many cases, such a result tends to exacerbate the physical conditions referred to above. In addition, the excessively flexible construction of the lighter shoes interferes with the rigidity needed to permit efficient propulsive foot movements by the wearer.

The problem of making athletic shoes lighter, and at the same time making them physically sturdy has been recognized for some time, and a variety ways have been proposed for simultaneously achieving both objectives.

One such approach is that described in U.S. Pat. No. 4,484,397, involving the control of a running shoe by means of a horizontal, somewhat "U"-shaped device consisting of an upper flange, for example, partially fitting over a heel wedge member, and connected by an extending sidewall to a lower flange fitting partially between the heel wedge and the lower midsole member. The rigid spacing of the flanges is intended to prevent compression of the heel wedge when the midsole compresses as the runner's foot rolls inward, in a manner intended to prevent pronation. The device suffers from its complexity, however, as well as from the fact that by preventing compression of part of the sole member, a harder foot support results, further aggravating some of the problems referred to.

Another device for reducing pronation and supination is described in U.S. Pat. No. 4,459,765, entailing a resilient heel member bonded to the exterior of the shoe which provides both vertical and longitudinal support and bracing. While the device may be effective with respect to the heel portion of the shoe, the corrective structure involves the drawback that it has minimal, or no effect on the equally important portions of the shoe distal to the heel, and that it provides no torsional reinforcement.

Still another approach suggested is that shown in U.S. Pat. No. 4,759,136 which makes use of a shoe that includes a midsole having a relatively soft central portion, and a peripheral portion of intermediate hardness extending around the central portion in the region of the heel and forward along each side of the shoe to the toe region. Although claiming to avoid overpronation and oversupination, the device makes no provision for torsional reinforcement.

An additional proposal is that disclosed in U.S. Pat. No. 4,625,435, which involves a device for preventing rolling of the heel portion of an athletic shoe. The device consists of an inverted "T" shaped plate whose horizontal inner flange is adapted for insertion between the shoe's upper and the shoe's sole. However, the device is without structure that would prevent torsional twisting, and is configured in a way that would beneficially affect only the heel of the shoe.

U.S. Pat. No. 4,288,929 shows a tray-like roll control device with upwardly sloping walls intended for placement in the heel portion of an athletic shoe. No protection is afforded to the frontal region of the foot, however, and even the torsional reinforcement in the heel area would be relatively marginal.

Other approaches have involved multiple layer midsoles of differing densities, U.S. Pat. No. 4,694,591; multiple component heel members of differing densities U.S. Pat. No. 4,730,402; horseshoe-shaped heel structures, U.S. Pat. No. 4,490,928; shoes with a peripheral sole portion having one density, and an inner sole portion of a different density, U.S. Pat. No. 4,302,892, and a variety of others. While all of the devices are designed to provide support of one type or another, none offer the torsional support provided by the invention disclosed herein, and none are designed to protect the area of the foot which this invention contemplates.

DISCLOSURE OF THE INVENTION

In view of the foregoing, therefore, it is a first aspect of this invention to provide a lightweight athletic shoe with superior torsional resistance.

A second aspect of this invention is to provide an athletic shoe that reduces injuries to wearers thereof caused by undesirable characteristics resulting from the shoe's lightweight construction.

Another aspect of this invention is to provide a lightweight athletic shoe with a reinforcement rigidified by a vertical flange that resists torsional forces acting on the shoe.

A further aspect of this invention is to provide a lightweight athletic shoe reinforcement.

An additional aspect of this invention is to furnish a lightweight athletic shoe that resists both pronation and supination over a substantial part of its length.

A yet further aspect of this invention is to provide a relatively simple, inexpensive device for strengthening lightweight athletic shoes against torsion generated from forces created by the wearer's foot during locomotion.

Still another aspect of this invention is to enhance the propulsive efficiency of lightweight athletic shoes.

The preceding and additional aspects of the invention are provided by an athletic shoe that includes a substantially flat reinforcement plate member, and a substantially vertical flange member, wherein said plate member is disposed substantially parallel to, and below the sole of the wearer's foot, said plate member extending rearwardly across the width of the shoe from a transverse line located behind and adjacent to the wearer's metatarsal/phalangeal joints, at least to a transverse line located substantially adjacent to the front of the heel of said wearer, and wherein except for the transverse edge forward of the shoe's heel-end, said flange member is attached to the edges of said plate member, at least along a substantial part of the lateral edges of said plate member between said lines.

The preceding and additional aspects of the invention are provided by a reinforcement device comprising a substantially flat portion and a flange, said device being configured to conform to that portion of an athletic shoe below and parallel to the sole of a wearer's foot extending from a transverse line located behind and adjacent a wearer's metatarsal/phalangeal joints, at least to a transverse line located substantially adjacent the front of the heel of a wearer, wherein said flange comprises a substantially vertical member which, except for the transverse edge forward of the shoe's heel-end, is attached to the edges of said plate, at least along a substantial part of the lateral edges of said device between said lines.

BRIEF DESCRIPTION OF THE DRAWINGS

The invention will be better understood when reference is had to the following drawings, in which like-numbers refer to like-parts, and in which.

DETAILED DESCRIPTION OF THE INVENTION

Figure 1:
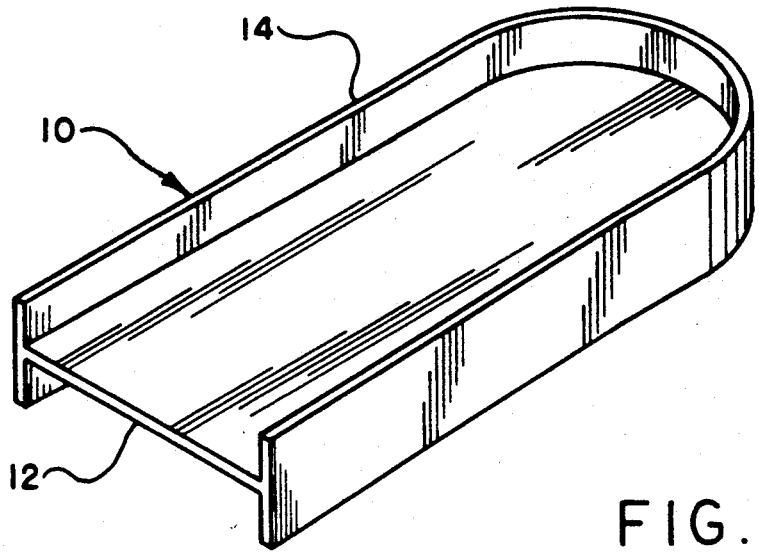
FIG. 1 is an isometric view of the shoe reinforcement of the invention.

FIG. 1 is an isometric view of the shoe reinforcement of the invention, generally 10, illustrating the horizontal base member 12 to which is attacted the rigidifying edge flange 14.

The purpose of the horizontal base 12 is to prevent torsional twisting of the lower portion of the shoe on which the wearer's foot rests; however, by itself, the base member would be insufficient to stiffen the lower part of the shoe sufficiently to successfully resist the twisting forces which cause the objectionable pronation and supination of the wearer's foot. The problem is overcome through the use of edge flange 14 which is anchored against the sides of the lower portion of the shoe, and which is integrally attached to the horizontal base member, forming a reinforced I-beam-like rigid structure.

Preferably, the torsional stabilizer 10 extends from the rear of the heel of the wearer to a line located just behind and adjacent to the wearer's metatarsal/phalangeal joints, as will be explained in greater detail in connection with FIG. 3.

The stabilizers 10 are particularly useful with lightweight athletic shoes, such as running shoes; however, they are equally useful with lightweight shoes intended for other uses, such as tennis shoes, bowling shoes and the like.

Figure 2:
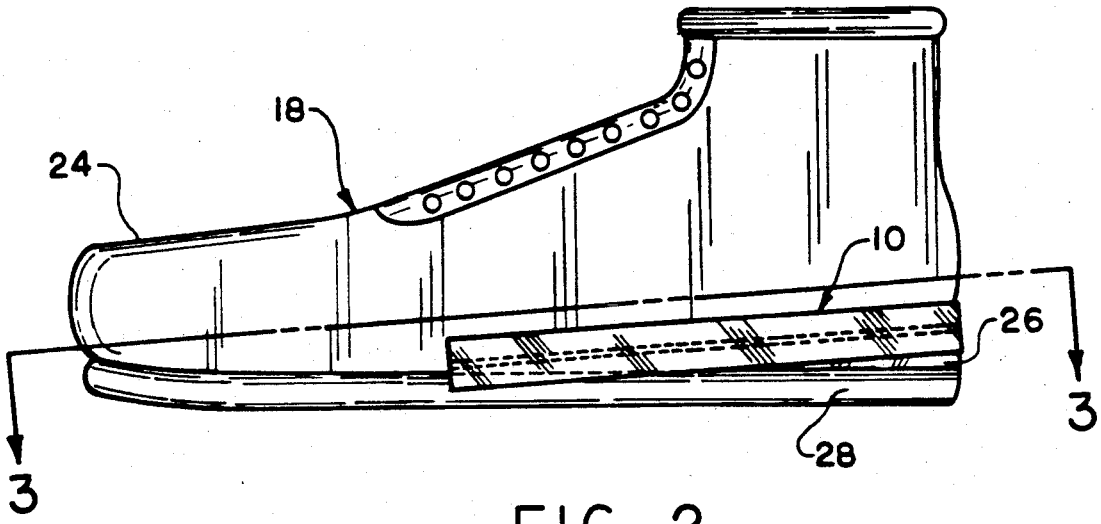
FIG. 2 is a side elevation of an athletic shoe provided with the reinforcement of FIG. 1.

FIG. 2 is a side elevation of an athletic shoe, generally 18, provided with a stabilizer of the invention 10. As illustrated, the shoe comprises an outsole 28 fastened to a midsole 26, the latter being attached to the shoe upper 24. The torsional stabilizer 10 is conveniently installed by cementing it in place with an adhesive cement, for example, between the shoe upper and the shoe midsole. Alternatively, the stabilizer may be formed as a part of the shoe's midsole. Whatever its positioning, however, the horizontal base member of the stabilizer is importantly reinforced against torsional twisting by its proximity to, and support gained from the adjacency of the flange 10 to the sides of the shoe components as previously described. In the case of attachment by means of an adhesive cement, any of the cements normally employed in connection with shoe construction may be successfully employed.

Figure 3:
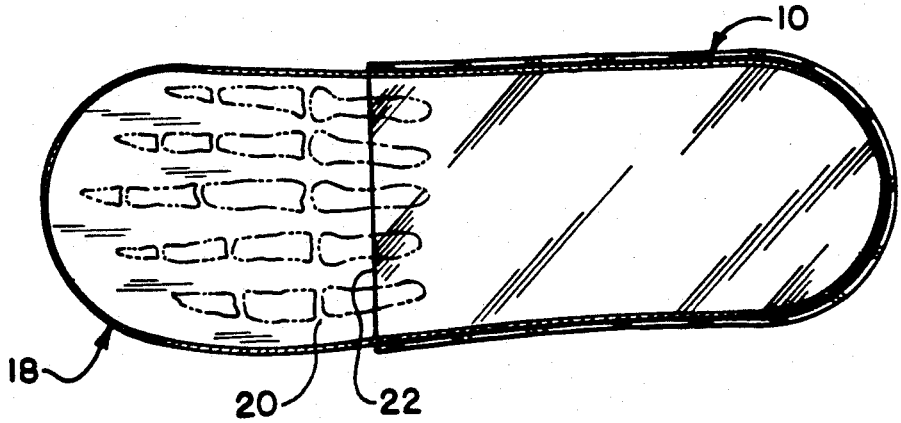
FIG. 3 is a plan view of the reinforced shoe of FIG. 2 along line 3—3 of FIG. 2.

FIG. 3 is a plan view of the reinforced shoe of FIG. 2, along line 3—3 of FIG. 2, showing positioning of the torsional stabilizer 10 from a transverse line 22 located behind and adjacent to the wearer's metatarsal/phalangeal joints 20 to the rear of the heel portion of the shoe 18.

Recognizing that the larger the area covered by the stabilizer 10, the greater will be its resistance to torsional forces, it is nevertheless necessary to terminate the stabilizer behind the metatarsal-phalangeal joints to permit full flexion of the wearer's foot. However, it is desirable that the terminal line 22 extend as far forward as possible without interfering with the joints to assure maximum reinforcement of the shoe.

Figure 4:
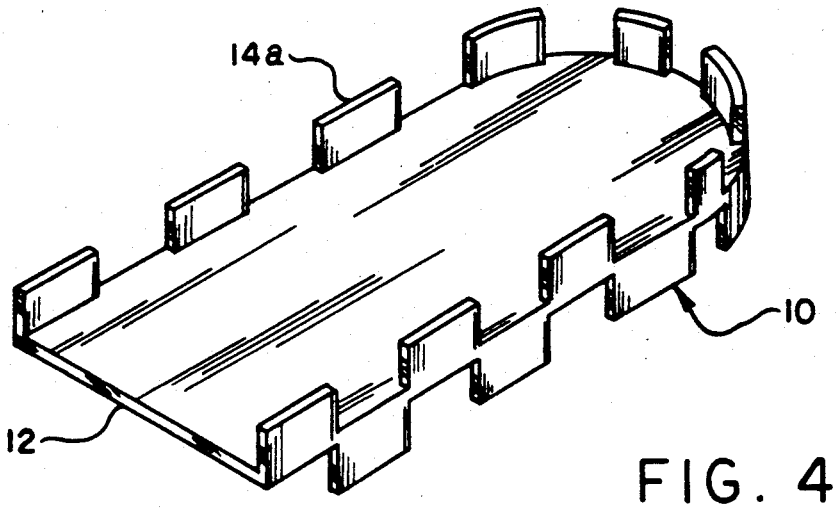
FIG. 4 is an isometric view of the shoe reinforcement of the invention in which the edge flange is segmented.

FIG. 4 is an isometric view of the shoe stabilizer or reinforcement device of the invention 10 in which the edge flange 14*a*, attached to the horizontal base 12, has been segmented. The segmentation provides a further means for desirably lightening the shoe without significantly interfering with the support of the edge flange. As shown in the Figure, the flange segments extending upwardly, alternate with those extending downwardly. While this is a preferred configuration, other alternating segmented sequences might also be employed.

While any of various materials can be used to fabricate the torsional stabilizer of the invention, the use of plastics, particularly thermoplastics such as the polyolefins, e.g., polyethylene, polypropylene, etc., is preferred. Other plastics can also be used, however, such as polyurethanes, reinforced fiberglass, graphite composites and other materials, both plastic and non-plastic.

While the use of a torsional stabilizer whose transverse cross-section, in effect, takes the form of a horizontal "I-beam" is a preferred embodiment of the invention because of the structural stability inherent in an I-beam configuration, modifications of the horizontal base member may be made. For example, the base member can be ergonomically molded to conform to the natural topography of the sole of an individual's foot.

Figure 5:
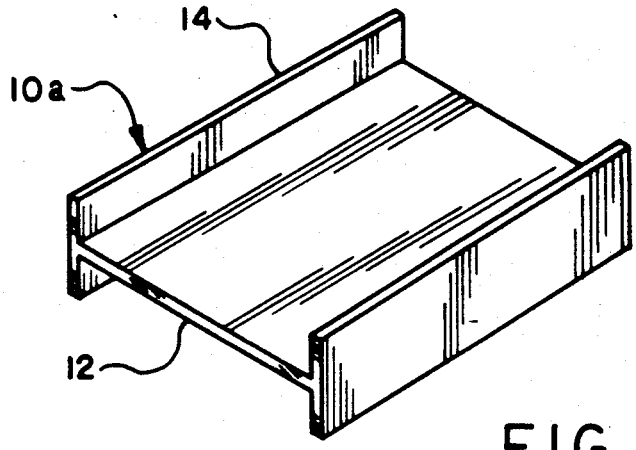
FIG. 5 is another embodiment of the invention illustrating a lightweight shoe reinforcement.

FIG. 5 is another embodiment of the invention illustrating a lightweight reinforcement stabilizer 10*a* comprising a horizontal base member 12 fabricated as a single piece with the edge flange 14, a preferred method of fabrication, although other methods well-known in the art are possible. As previously indicated, it is desirable that the stabilizer member 10*a* extend from just behind the metatarsal/phalangeal joints, to the heel-end of the shoe. In some instances, however, in the interest of lightening the shoe still further, the rear end of the stabilizer may be terminated at a transverse line located substantially adjacent to the front of the heel of a wearer. Such a lightened version is illustrated in the Figure.

The dimensions of the stabilizer may be varied within fairly broad limits; however, it is desirable that the walls of the horizontal base member 12 and the edge flange 14 have a thickness of from about 1 millimeter to about 25 millimeters, a thickness of from about 2 millimeters to about 4 millimeters being especially desirable. The lower portion of the edge flange 14 may extend to a point level with the lower surface of the outsole, or even somewhat below such point, to a point above the horizontal base member 12. The overall height of the flange member, however, will normally be from about 1 centimeter to 10 centimeters, at least part of the flange extending above, and part below the horizontal base member 12. In addition, the height of the flange below the base member will typically about equal the height of the flange above the base member, although different heights may be employed if desired.

Of the embodiments described, the preferred embodiment comprehends extension of the stabilizer from the metatarsal/phalangeal joints to the rear of the shoe heel, although as indicated, it may be shortened in the interest of lighter overall weight. In the case of the shortened, lightweight stabilizers, the stabilizer will at least be long enough so that it extends from about 3 to 5 inches behind the metatarsal/phalangeal joints.

Figure 6:
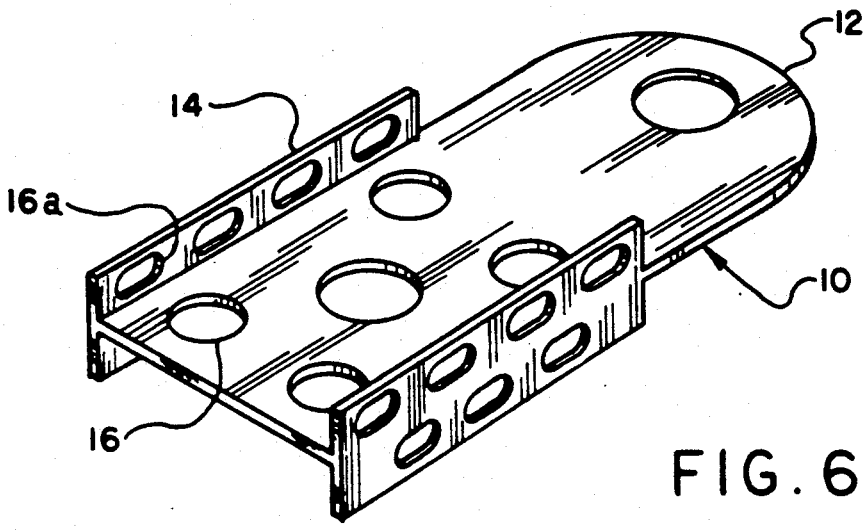
FIG. 6 is a further embodiment of a lightweight reinforcement of the invention.

FIG. 6 is a further embodiment of a lightweight reinforcement stabilizer of the invention 10 in which the edge flange 14 has been foreshortened in the interest of reducing the weight of the stabilizer. To achieve an additional weight reduction, the stabilizer has also been provided with perforations 16 in the horizontal base member 12, as well as with perforations 16*a* in the flange 14. The perforations shown have a circular shape in the base plate member, and an elongated shape in the flange portion. Perforations having other shapes may also be used, however, and the distribution of the perforations is not limited to that illustrated in the Figures.

While in accordance with the patent statutes, a preferred embodiment and best mode has been presented, the scope of the invention is not limited thereto, but rather is measured by the scope of the attached claims.

What is claimed is:

1. An athletic shoe that includes a substantially flat rigidifying reinforcement plate member attached to a substantially vertical flange member, said flange member extending partially above, and partially below said plate member, wherein said plate member is disposed substantially parallel to, and below the sole of a wearer's foot when the shoe is worn, said plate member extending fully between portions of said flange rearwardly across the width of the shoe from a transverse line located at a forward region of the wearer's arch continuously at least, to a location substantially adjacent the front of the heel of the wearer's foot, said flange member being attached to the lateral edges of said plate member along at least a substantial part of the lateral edges of said plate member extending rearwardly from said line.

2. An athletic shoe according to claim 1 wherein said flange member extends rearwardly from said line to at least substantially adjacent the front of the heel of said wearer.

3. An athletic shoe according to claim 1 wherein said plate member extends to the rear of the heel-end of the shoe, and except for the edge adjacent said line, said vertical flange member is attached to the entire edge of said plate member.

4. An athletic shoe according to claim 1 wherein said flange member is segmented and comprises first segments disposed below said plate member, and second segments disposed above said plate member.

5. An athletic shoe according to claim 1 wherein said plate member extends rearwardly across the width of the shoe from said transverse line located at the interface between the instep and the forefoot of the shoe.

6. An athletic shoe according to claim 1 in which at least some of said members are perforated.

7. An athletic shoe according to claim 1 wherein said plate member is positioned at a location selected from the group consisting of a location between the shoe upper and the shoe midsole, and a location through a plane interior of, and parallel to the shoe's midsole.

8. A shoe rigidifying reinforcement device in a shoe comprising a substantially flat portion and an attached flange, the flat portion of said device being configured and conforming to that portion of the shoe which would be parallel to the sole of a wearer's foot and said flat portion extending fully between portions of said flange across the shoe's width from a transverse line located at a forward region of a wearer's arch continuously at least, to a location substantially adjacent the front of the heel of the wearer's foot wherein said flange extends partially above, and partially below said flat portion, and is attached to the edges of said flat portion along at least a substantial part of the lateral edges of said device rearward of said line.

9. A shoe reinforcement device according to claim 8 wherein said flange member extends rearwardly from said line to at least substantially adjacent the front of the heel of said wearer.

10. A reinforcement device according to claim 8 wherein said flat portion rear of the extends to the heel-end of the shoe and, except for the edge adjacent said line, said flange is attached to the entire edge of said device.

11. A reinforcement device according to claim 8 wherein said flange is segmented, comprising first segments disposed below said flat portion, and second segments disposed above said flat portion.

12. A reinforcement device according to claim 8 which is provided with perforations therein.

13. A shoe reinforcement device according to claim 8 wherein said transverse line is located at the interface between the instep and the forefoot of the shoe.

14. An athletic shoe that includes a substantially flat reinforcement plate member attached to a substantially vertical flange member, said flange member extending partially above, and partially below said plate member, wherein said plate member is disposed substantially parallel to, and below the sole of the wearer's foot, said plate member extending rearwardly across the width of the shoe from a transverse line located behind and adjacent to the wearer's metatarsal/phalangeal joints at least to substantially adjacent the front of the heel of said wearer, said flange member being attached to the lateral edges of said plate member along at least a substantial part of the lateral edges of said plate member extending rearwardly from said line, wherein said flange member is segmented and comprises first segments disposed below said plate member, and second segments disposed above said plate, and, wherein said first and second segments alternate with each other.

* * * * *